US005842280A

United States Patent [19]

Robell

[11] Patent Number: 5,842,280

[45] **Date of Patent: *Dec. 1, 1998**

[54] GRIDDED MEASUREMENT SYSTEM FOR CONSTRUCTION MATERIALS

[76] Inventor: Glenn Robell, 2621 SW. 167 Pl., Seattle, Wash. 98166

[ * ] Notice: The term of this patent shall not extend beyond the expiration date of Pat. No. 5,673,489.

[21] Appl. No.: 944,385

[22] Filed: Oct. 6, 1997

Related U.S. Application Data

[62] Division of Ser. No. 599,986, Feb. 14, 1996, Pat. No. 5,673,489.

[51] Int. Cl.[6] ..... G01B 3/00

[52] U.S. Cl. ..... 33/1 B; 33/566

[58] Field of Search ..... 33/1 B, 1 BB, 33/1 G, 1 K, 1 SD, 404, 411, 494, 562, 563, 566, 194; 52/105

[56] References Cited

U.S. PATENT DOCUMENTS

| | | | |
|---|---|---|---|
| 275,822 | 4/1883 | Hagan | 33/1 K |
| 2,375,427 | 5/1945 | Mannino | 33/1 B |
| 4,730,398 | 3/1988 | Stanton | 33/1 K |
| 4,779,346 | 10/1988 | Schafer | 33/1 B |
| 4,827,621 | 5/1989 | Borsuk | 33/1 B |
| 4,858,402 | 8/1989 | Putz | 52/105 |
| 4,870,788 | 10/1989 | Hassan | 52/105 |
| 5,195,249 | 3/1993 | Jackson | 33/1 B |
| 5,206,965 | 5/1993 | Rowley | 30/125 |
| 5,265,342 | 11/1993 | Lang, Jr. | 30/290 |
| 5,282,317 | 2/1994 | Carter et al. | 33/1 B |
| 5,673,489 | 10/1997 | Robell | 33/1 B |

FOREIGN PATENT DOCUMENTS

| | | | |
|---|---|---|---|
| 590105 | 7/1947 | United Kingdom | 33/1 B |
| 1578521 | 11/1980 | United Kingdom | 33/1 B |

*Primary Examiner*—G. Bradley Bennett
*Attorney, Agent, or Firm*—Dorothy S. Morse

[57] ABSTRACT

A means of gridded measurement for the cutting of construction materials which comprises the imprinting of visually precise commonly used measurement markings upon the surfaces of construction materials during the manufacturing process to save time and improve the accuracy of cutting the construction materials on a job site. Unit markings may be numbered for quick dimensional reference and fractional markings may also be used. The lines for commonly used markings may also be highlighted, darkened, doubled, tripled, dashed or dotted, and color enhanced for easy recognition. Applications may include, but are not limited to, use on wallboard, shower board, insulation, gypsum board, plywood, and any other material which must be cut to exact measurements on a construction job site. Angled cuts may be easily made by cutting along the opposite corners of a predetermined number of grids counted in both horizontal and vertical directions.

10 Claims, 2 Drawing Sheets

GRIDDED MEASUREMENT SYSTEM FOR CONSTRUCTION MATERIALS

This patent application is a divisional application based upon the disclosure provided by applicant in his previously filed patent application Ser. No. 08/599,986, filed on Feb. 14, 1996, which is due to issue as U.S. Pat. No. 5,673,489 on Oct. 7, 1997.

BACKGROUND—FIELD OF INVENTION

The present invention relates to methods and devices for accurately cutting construction materials, specifically to a time saving means and a means by which to improve the accuracy of cutting construction materials on a job site which involves the imprinting during manufacture of gridded measurement markings onto the surfaces of construction materials. Applications may include, but are not limited to, use on wallboard, shower board, insulation, gypsum board, plywood, and any other material which must be cut to exact measurements on a construction or renovation job site.

BACKGROUND—DESCRIPTION OF PRIOR ART

During construction and renovation work building materials must be accurately measured prior to cutting to ensure that they will perform the functions for which they were intended. When building materials are mismeasured and a cut piece is too large for its intended use, additional time must be spent to reshape it. If a cut piece is too small and subsequently used, gaps may be present in a finished structure which detract from its appearance, and the functional integrity of the structure may also be compromised. Materials cut too small and discarded result in financial loss. Therefore, it is desirable to have a means for accurately and expediently cutting building materials on construction and renovation job sites.

One way to create a smaller piece of construction material out of a larger one is through the use of a tape measure and a marking device, such as a pencil, to place a series of small marks upon at least one surface of the large piece of construction material at a measured distance from one of its straight edges. The person cutting the material may then use the marks as an approximate cutting guide. In the alternative, the person needing to cut the construction material can connect two or more of the marks with a line, such as by use of a snapped chalk line or by using a pencil and a straight edged device, the line then being used as the cutting guide. The main disadvantage of making and connecting measurements marked on a piece of construction material at a job site is that it is time consuming. When sufficient time is taken to accurately place the marks, the accuracy of the cut is greatly improved. However, human error is common in measuring multiple small marks. People coming to work tired for a variety of reasons, those working outside for extended hours in extreme temperature conditions, and those pressured to finish a project in a short period of time, do not always focus their attention on the tape measure markings and can easily misread them, particularly the fractional markings. Also, lines which are thickly marked onto construction materials may also lead to cutting errors, particularly when a variance in the portion of the thick line cut is extended the full length of a four foot by eight foot, four foot by ten foot, or four foot by twelve foot sheet of construction material. The mistakes which result from such cutting errors waste both time and materials if they are not corrected prior to cutting.

Cutting tools are also known which aid in making precise cuts in drywall and other construction materials. The invention in U.S. Pat. No. 5,206,965 to Rowley (1993) discloses a utility knife with an angled structure associated with its housing which provides a guiding surface for making angled or mitered cuts along the edge of a piece of construction material, such as drywall. The invention in U.S. Pat. No. 5,265,342 to Lang, Jr. (1993) discloses a knife fastened to a rod which passes through an opening in a guide that rides along the edge of a piece of construction material. Graduations on the rod allow new cut widths without the repeated use of tape measures and marking devices. One disadvantage of using the Lang, Jr. cutting tool is that it is only able to cut lines which are parallel to the straight edge along which the guide is placed. Angled and mitered cuts are not possible with the Lang, Jr. invention.

Intersecting and angled lines printed upon construction materials are also known. The inventions in U.S. Pat. No. 4,858,402 to Putz (1989) and U.S. Pat. No. 4,870,788 to Hassan (1989) both disclose lined patterns on construction materials to facilitate the use and placement thereof. However, the present invention offers a person needing to cut construction materials with an even faster and more accurate system and method for cutting the construction materials than is possible with any known prior art, particularly when the person is cutting irregularly shaped remnant pieces of construction material. Use of the present invention minimizes construction waste due to mismeasurement, and each piece of the present invention used on a construction site, including remnant pieces, will also provide a handy on-site, time-saving reference for other measurement needs, a reference that is accurate to one-eighth of an inch, or its metric equivalent.

SUMMARY OF INVENTION—OBJECTS AND ADVANTAGES

It is the primary object of this invention to provide a system and method by which to enhance the accuracy of cutting pieces of construction materials so as to prevent waste of construction materials. It is also an object of this invention to provide a time saving means by which to accurately cut pieces of construction materials. A further object of this invention is to provide an easy and expedited means for making angled or mitered cuts on pieces of construction materials. It is also an object of this invention to provide imprinted measuring grids on pieces of construction material which are sized and highlighted in a variety of commonly used measuring units. A further object of this invention is to provide an imprinted grid-within-a-grid measuring system having fractional measurements for accurate measurement to one-eighth of an inch, or its metric equivalent.

As described herein, properly manufactured and imprinted on a piece of construction material, the present invention would provide a time saving means of accurately cutting the construction material. Precisely marked gridded lines, spaced apart from one another in standard measurement units, would be placed both horizontally and vertically on at least one side of a piece of construction material. Numerals would be indicated in association with whole measuring units for fast identification of dimensions which are required for a cut. Fractional markings would also be available for increased precision in cutting the construction material. It is contemplated for the lines marking commonly used measurements, such as the sixteen inch measurement between studs, to be highlighted, darkened, doubled, tripled, dashed, dotted, or color enhanced on the grid for quick reference. Angled and mitered cuts could be easily made by cutting along the opposite corners of a predetermined number of grids counted in both horizontal and vertical directions. The gridded measurement markings provide a quick measurement reference, but they also provide convenient guides for cutting a straight line through a piece of construction material. Also, a quick look at the markings on a previously cut piece of construction material having the grid measurement system of the present invention will reveal the presence of a straight edge or a 90-degree angle between adjacent edges without measurement.

The description herein provides preferred embodiments of the present invention but should not be construed as limiting the scope of the gridded drywall invention. Variations in the units used to configure the grids, the selection of fractional markings displayed, the selection of commonly used construction measurements chosen for highlighting, darkening, doubling, tripling, dashing, dotting, or color enhancing, the frequency of the numerals used to identify grid units, and the use of numerals for other grid measurement markings, other than those shown and described herein, can be incorporated into the present invention. Thus the scope of the present invention should be determined by the appended claims and their legal equivalents, rather than the examples given.

DETAILED DESCRIPTION OF PREFERRED EMBODIMENTS

Figure 1:
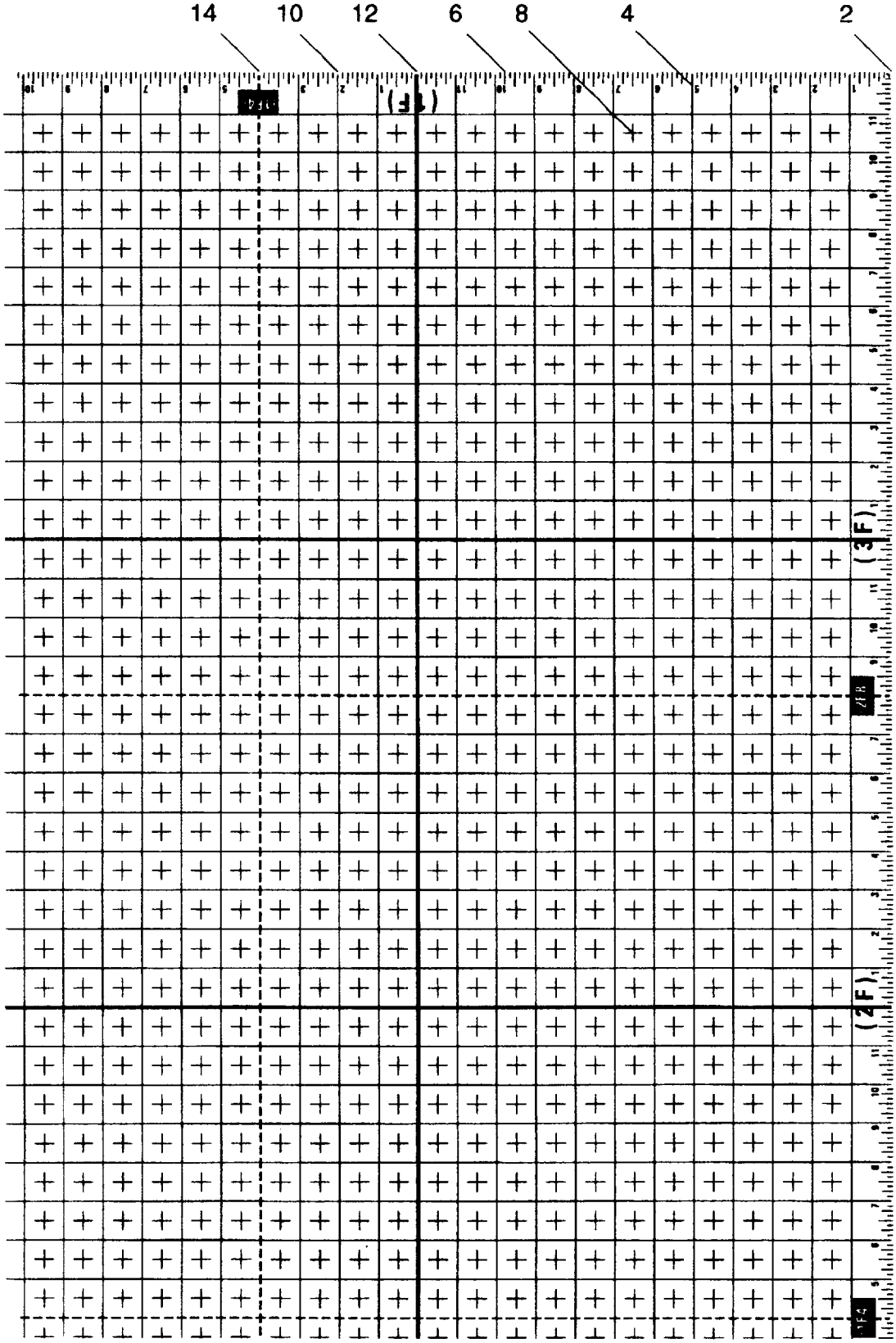
FIG. 1 is a top view of the invention having multiple highlighted markings.
Figure 2:
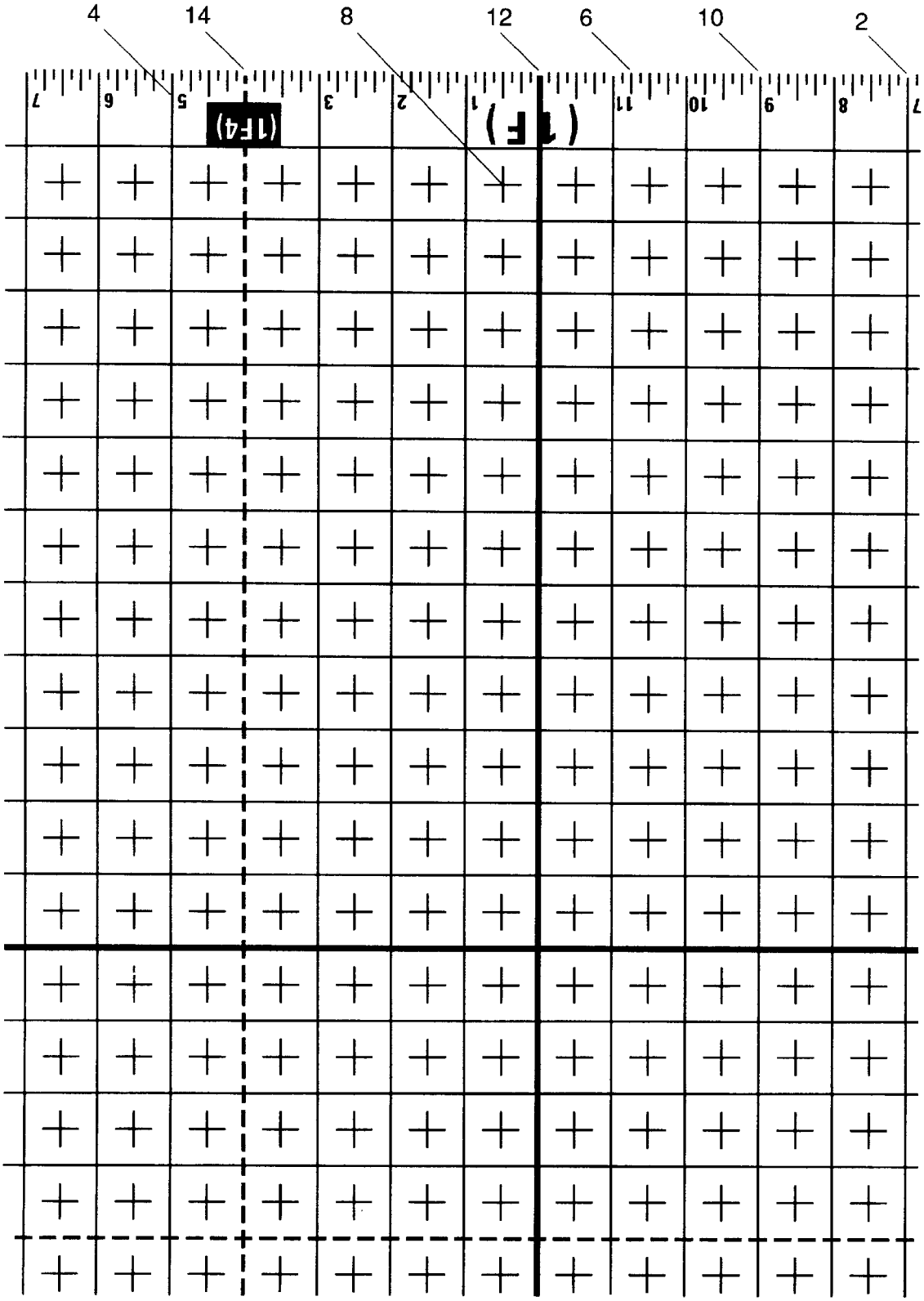
FIG. 2 is an enlarged top view of the invention.

FIGS. 1 and 2 show a preferred embodiment of a grid measurement system 2 for use with a variety of building materials (not shown), to include wallboard, shower board, insulation, gypsum board, plywood, and any other material, particularly four foot by eight foot, four foot by ten foot, and four foot by twelve foot sheets, which must be cut to exact measurements on a construction or a renovation job site. FIGS. 1 and 2 show grid measurement system 2 having visually precise one-fourth inch markings 6, one-half inch markings 8, one-inch markings 10, twelve inch enhanced markings 12, and sixteen inch highlighted markings 14 indicated in both horizontal and vertical directions. Sixteen inch highlighted markings 14 are used as a quick reference for the sixteen inch distance commonly used in the construction industry between studs (not shown). FIGS. 1 and 2 also show grid measurement system 2 having numerals 4 associated with one-inch markings 10.

Although the preferred embodiment of grid measurement system 2 shows markings in inches, it is contemplated for markings to also be in other commonly used measurement units, such as metric units. Further, it is also contemplated for numerals 4 to be associated with markings other than one-inch markings 10, and to be associated with either odd or even one-inch markings 10. In addition, it is contemplated for commonly used measurements needed for reference, other than twelve inch markings 12 and sixteen inch markings 14 to be highlighted or enhanced. It is also contemplated for highlighting and enhancing to include, but not be limited to, color enhancement, darkening of lines, doubling of lines, tripling of lines, and a series of dots adjacent to or in place of a line. Highlighting could also include dashed lines with each dashed mark having an identical measurement useful to the construction industry, such as one-half inch marking 8 with spaces between each dashed mark also having the same identical measurement. Although FIGS. 1 and 2 show one-fourth inch markings 6 and one-half inch markings 8, it is contemplated to have other fractional markings as needed to suit a particular construction purpose.

Angled and mitered cuts are easy to make using the visual precision of grid measurement system 2. A 45-degree angled cut may be made without measurement by cutting through opposite corners of one-inch markings 10. Other angles may be cut along the opposite comers of a predetermined number of one-inch markings 10 counted in both horizontal and vertical directions. For convenience in cutting such angles, a straight edge (not shown) and a marking device (not shown) may be used to draw a line connecting the counted opposite corners. However, no angle measurements need to be determined, a process which is commonly the subject of human error. It is contemplated for grid measurement system 2 to be imprinted on construction materials of any thickness, including all four foot by eight foot, four foot by ten foot, and four foot by eight foot construction materials. Grid measurement system 2 may be imprinted for an insignificant cost, as compared to the cost of the construction material itself (not shown), by screen printing, laser guided printing, or pad printing.

What is claimed is:

1. A gridded measurement system for use on at least one surface of a piece of construction material having a rectangular perimeter so as to provide a visually precise means for fast and accurate cutting of construction materials whereby use thereof will reduce construction costs by minimizing the amount of labor required to measure construction materials as well as minimize material waste due to inaccurate cutting of construction materials, said gridded measurement system comprising a plurality of horizontal unit measurement markings positioned upon said piece of construction material, a plurality of precise vertical unit measurement markings positioned upon said piece of construction material, a plurality of successively higher numbers associated with said horizontal unit measurements markings and said vertical unit measurements markings, a plurality of grid markings positioned within the central portion of the construction material surface and extending at least part of the distance between adjacent ones of said horizontal unit measurement markings and adjacent ones of said vertical unit measurement markings, each of said grid markings also having a spaced apart horizontal distance from the next adjacent one of said grid markings which is identical to the dimension of said horizontal unit measurement markings and a spaced apart vertical distance from the next adjacent one of said grid markings which is identical to the dimension of said vertical unit measurement markings, said system also comprising marking means for visually precise marking of said unit measurement markings, said grid markings, and said successively higher numbers onto the construction material surface.

2. The gridded measurement system of claim 1 wherein said visually precise units measurement markings are positioned on construction materials selected from a group consisting of four foot by eight foot sheets, four foot by ten foot sheets, and four foot by twelve foot sheets.

3. The gridded measurement system of claim 1 further comprising a plurality of visually precise fractional measurement markings positioned in both horizontal and vertical directions on said construction material surface between said unit measurement markings.

4. The gridded measurement system of claim 1 further comprising a plurality of highlighted markings positioned in both horizontal and vertical directions on top of the ones of said unit measurement markings which are commonly used in construction so that said highlighted markings may be quickly referenced by a user.

5. The gridded measurement system of claim 4 wherein said highlighted markings are selected from a group consisting of color enhanced markings, multiple lines, and dashed lines having a plurality of segments identical in length and positioned at equally spaced apart distances from one another.

6. The gridded measurement system of claim 1 wherein said unit markings comprise one-inch markings.

7. The gridded measurement system of claim 6 further comprising a plurality of highlighted markings positioned in both horizontal and vertical directions on top of every one of said one-inch markings which is a multiple of twelve for quick reference by a user.

8. The gridded measurement system of claim 6 further comprising a plurality of highlighted markings positioned in both horizontal and vertical directions on top of every one of said one-inch markings which is a multiple of sixteen for quick reference by a user.

9. The gridded measurement system of claim 1 wherein said unit markings comprise metric system markings.

10. The gridded measurement system of claim 1 wherein said marking means is selected from a group consisting of screen printing equipment, laser printing equipment, and pad printing equipment.

* * * * *